US010683745B2

(12) United States Patent
Martin et al.

(10) Patent No.: US 10,683,745 B2
(45) Date of Patent: Jun. 16, 2020

(54) APPARATUS AND METHOD FOR PREVENTING COLLISIONS WHILE MOVING TUBULARS INTO AND OUT OF A WELLHEAD

(71) Applicant: Intelligent Wellhead Systems Inc., Sturgeon County (CA)

(72) Inventors: Bradley Robert Martin, Red Deer (CA); Robert Louis Hug, Rimbey (CA); Calvert Joseph Vallet, Edmonton (CA)

(73) Assignee: Intelligent Wellhead Systems Inc., Calgary (CA)

( * ) Notice: Subject to any disclaimer, the term of this patent is extended or adjusted under 35 U.S.C. 154(b) by 145 days.

(21) Appl. No.: 15/822,929

(22) Filed: Nov. 27, 2017

(65) Prior Publication Data

US 2018/0149016 A1 May 31, 2018

Related U.S. Application Data

(60) Provisional application No. 62/426,362, filed on Nov. 25, 2016.

(51) Int. Cl.

| | |
|---|---|
| ***E21B 47/09*** | (2012.01) |
| ***E21B 23/00*** | (2006.01) |
| ***E21B 33/06*** | (2006.01) |
| ***E21B 47/08*** | (2012.01) |

(52) U.S. Cl.

CPC ..... *E21B 47/0905* (2013.01); *E21B 23/00* (2013.01); *E21B 33/061* (2013.01); *E21B 47/08* (2013.01)

(58) Field of Classification Search

CPC ..... E21B 23/00; E21B 33/061; E21B 47/08; E21B 47/0905

See application file for complete search history.

(56) References Cited

U.S. PATENT DOCUMENTS

| | | | | |
|---|---|---|---|---|
| 5,014,781 | A * | 5/1991 | Smith | E21B 19/00 166/384 |
| 9,587,461 | B1 * | 3/2017 | Jaffrey | E21B 34/04 |
| 2003/0010495 | A1 * | 1/2003 | Mendez | E21B 47/0905 166/255.1 |
| 2015/0167446 | A1 * | 6/2015 | Taskinen | E21B 47/00 166/382 |
| 2015/0240625 | A1 * | 8/2015 | Carlson | E21B 17/04 166/66 |

* cited by examiner

*Primary Examiner* — Caroline N Butcher
(74) *Attorney, Agent, or Firm* — Osha Liang LLP

(57) ABSTRACT

An apparatus that includes at least two well control mechanisms and at least one sensor to avoid collision between a section of a tubing string coupler or that is moving through the apparatus and a wellbore to which the apparatus is coupled. The sensors detect the presence of magnetic objects, such as sections of a tubing string, and measure their respective outer diameters (OD). The sensors detect when any larger OD sections of the tubing string before the larger OD section can collide with one of the well control mechanisms. The sensors direct their outputs to a controller that can identify an imminent collision state. When an imminent collision state is identified, the controller will send commands to stop movement of the tubular to avoid the collision. Movement of the tubular will not resume until the well control mechanism has been actuated to avoid collision with the larger OD section.

20 Claims, 5 Drawing Sheets

APPARATUS AND METHOD FOR PREVENTING COLLISIONS WHILE MOVING TUBULARS INTO AND OUT OF A WELLHEAD

TECHNICAL FIELD

This disclosure generally relates to completing an oil or gas well. In particular, the disclosure relates to an apparatus and method for preventing collisions when moving tubulars and components through an oil or gas well blow-out preventer.

BACKGROUND

After an oil and gas well is drilled, tubulars are moved through a surface wellhead by a hydraulic workover rig. Tubulars are typically connected to each other by couplers to form a tubing string. The tubing string extends through a wellbore that is defined by equipment on the surface and by a well below the surface. The couplers define a larger outer diameter (OD) section of the tubing string as compared to other sections of the tubing string. Other components, such a downhole tool, can also be incorporated into the tubing string and, similar to the couplers, these other components can define a larger OD section of the tubing string.

A hydraulic workover rig typically uses a hydraulically-powered jack plate and slips to engage and move the tubular in the desired direction through the wellhead (i.e. into the well or out of the well). Tubulars that move through a wellhead must pass through one or more blowout-preventers (BOPs). One type of BOP is a ram BOP. A ram BOP has two, opposing hydraulically-actuated rams that move into a wellbore that is defined by the wellhead to form a seal about the outer surface of the tubulars. This seal contains the reservoir pressure of the well. However, different types of tubulars and even the same types of tubulars that may be moving through the wellhead can have different lengths. For example, one common form of tubular is referred to as pipe joint or a tubing joint. A tubing joint can have a length that ranges between about 7 meters and about 14 meters in length (one meter is equal to about 3.28 feet). Another common form of tubular is referred to as a pup joint. A pup joint can have a length that ranges between about 0.5 and 4 meters. This discrepancy in tubular lengths makes it difficult for an operator of the hydraulic workover rig to know when a larger OD section of the tubing string is approaching one of the ram BOPs.

A collision between any moving parts within a wellhead can be catastrophic for the well, the equipment at the well site and personnel in the area.

SUMMARY

Embodiments of the present disclosure relate to an apparatus for avoiding collisions while moving tubulars through a wellhead. The apparatus comprises a blowout preventer system, a body, a sensor and a controller. The blowout preventer (BOP) system is connectible with the wellhead. The BOP system is configured to receive the tubing string therethrough and to move between an open position and a closed position. When the BOP system is in the closed position the BOP system forms at least one fluid tight seal against an outer surface of the tubing string. The BOP system generates a BOP output signal that indicates when the BOP system is in the closed position. The body has a central bore and the body is connectible in line with the wellhead. The sensor is for detecting and/or measuring the outer diameter (OD) of the tubing string as it passes through the central bore. The sensor is configured to generate a sensor output signal that indicates the OD of the tubing string. The controller is configured to receive the sensor output and the BOP output signal to determine if an imminent collision state exists. An imminent collision state exists if a larger outer diameter section of the tubing string is approaching the BOP system in the closed position.

BRIEF DESCRIPTION OF THE DRAWINGS

These and other features of the present disclosure will become more apparent in the following detailed description in which reference is made to the appended drawings.

FIG. 1 is a side-elevation view of one embodiment of a wellhead anti-collision apparatus, wherein.

FIG. 2 is a side-elevation view of another embodiment of the wellhead anti-collision apparatus, wherein.

DETAILED DESCRIPTION

Figure 1A:
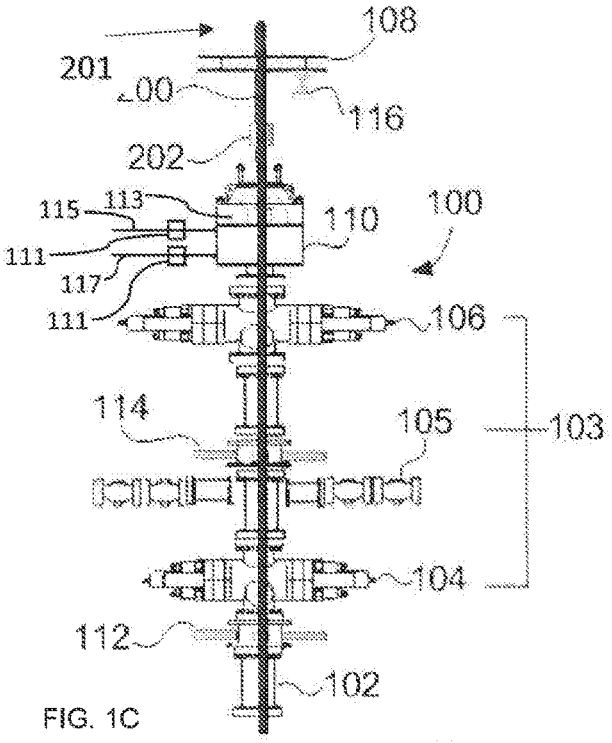
FIG. 1A shows a tubular being run into a well through the anti-collision apparatus, the tubular is at a first position.
Figure 1B:
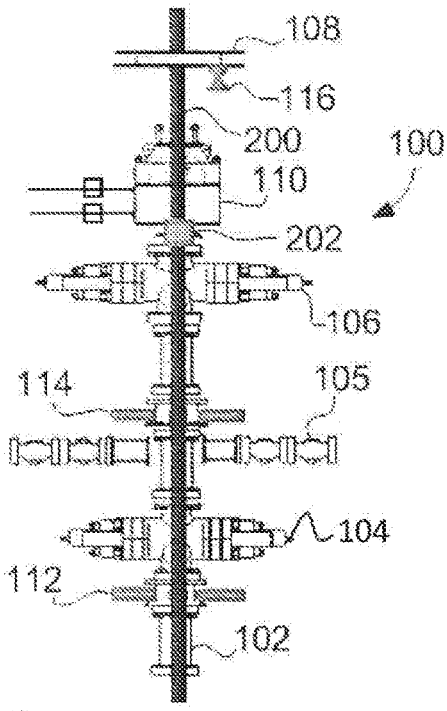
FIG. 1B shows the tubular at a second, lower position.

Embodiments of the present disclosure relate to an apparatus that includes at least two well control mechanisms and at least one sensor to avoid a collision between a tubing string that is moving through the apparatus with one of the at least two well control mechanisms. The well control mechanisms form at least one fluid-tight seal against the outer surface of the tubing string as it moves through the wellhead and the apparatus. The sensors detect the presence of magnetic objects, such as the components of a tubing string, and their respective outer diameters (OD). In particular, the sensors can measure the OD of the tubing string and detect when sections of the tubing string that have a larger OD are approaching, moving through and moving away from the sensors. The sensors are positioned relative to the at least two well control mechanism so that any larger OD sections of the tubing string will be detected before the larger OD section can collide with one of the well control mechanisms. The sensors direct their outputs to a controller that, among other tasks, can identify an imminent collision state. When an imminent collision state is identified, the controller will send commands to stop movement of the tubular to avoid the collision. Movement of the tubular will not resume until the well control mechanism has been actuated to avoid the collision with the larger OD section.

Embodiments of the present disclosure will now be described by reference to FIG. 1 through FIG. 5, which show embodiments of a wellhead anti-collision system according to the present disclosure.

FIG. 1 shows one embodiment of the present disclosure that relates to an anti-collision apparatus 100. The apparatus 100 is fluidly connected to a wellhead 102. The wellhead 102 can be secured to the surface for supporting components of an oil or gas well below the surface (not shown). The wellhead 102 defines an upper portion of a wellbore that is above the surface. The upper portion of the wellbore is in fluid communication with a lower portion of the wellbore that is defined by the well below the surface. The upper portion and the lower portion of the wellbore are typically continuous with each other.

FIG. 1 also shows a tubing string 201 being assembled by inserting and moving a tubular 200 through the apparatus 100. The tubular 200 can be a section of the tubing string 201 that is inserted into the wellbore through the apparatus 100 and the wellhead 102. Also shown in FIG. 1 is a section 202 of the tubing string 201 that has a larger, cross-sectional outer diameter (OD) than the other sections of the tubing string 201. For example, the larger OD section 202 can be a tubular 200, a coupler that is coupling two tubulars 200, a downhole tool or any other component that is incorporated into the tubing string 201 and that has a larger OD than the tubular 200. The coupler is a device that is used to couple individual tubulars 200 together so as to form the tubing string 201. FIG. 1A through FIG. 1D show the downward movement of the tubular 200 and a larger OD section 202 through the apparatus 100.

In some embodiments of the present disclosure, the apparatus 100 comprises a blowout preventer (BOP) system 103 with a first ram BOP 104, a second ram BOP 106 and an annular BOP 110. In other embodiments of the present disclosure the BOP system 103 includes only the first and second ram BOPs 104, 106 and may not include an annular BOP 110. In other embodiments of the present disclosure the BOP system 103 includes one ram BOP 104 (or 106) and one annular BOP 110. The BOP system 103 is used for well control by maintaining at least one fluid-tight seal against an outer surface of the section of the tubing string 201 that is moving through the upper portion of the wellbore. The at least one fluid-tight seal contains pressure within the well for preventing a blowout.

The first ram BOP 104 is positioned closer to the wellhead 102 and below the second ram BOP 106. In some embodiments of the present disclosure, the first ram BOP 104 and second ram BOP 106 both perform the same function and include the same components, while each may be independently controlled. Accordingly, the present disclosure will provide a description of the first ram BOP 104 and it is understood that unless otherwise stated, the same description also applies to the second ram BOP 106.

The first ram BOP 104 may also be referred to as a pipe ram BOP. The function and components of the first ram BOP 104 are generally known. The present disclosure provides a summary thereof in order to provide context to the other components of the apparatus 100. The function of the first ram BOP 104 is to provide an actuatable seal that can be established around the outer surface of the one or more tubulars 200 that form the tubing string 201 as they move through the wellhead 102 and the BOP system 103.

The first ram BOP 104 may include two opposing ram shafts that are each actuated by hydraulic pressure at a first end to move into and out of the wellbore. Alternatively, the ram shafts may be actuated by other means, such as pneumatic systems or electronic actuation systems. For the purposes of the present disclosure, when the ram shafts extend into the wellbore they form a fluid-tight seal about the outer surface of the tubular 200 that is within the first ram BOP 104, this is referred to as a closed position. When the ram shafts are retracted from the outer surface of the tubular 200 there is no fluid-tight seal, this is referred to as an open position. When the ram shafts are between the first position and the second position, this is referred to as an intermediary position.

A ram block is connected to a wellbore end of each ram shaft opposite to the first end. Each ram block is configured to seal about the outer surface of a tubular 200 when the ram shaft is in the closed position. For example, the ram block may comprise one or more sealing members that can form a fluid-tight seal against the outer surface of the tubular 200 and prevent the flow of fluids past the ram block within the space between the inner most surface of the wellbore and the outer surface of the tubular 200, which is referred to as the annular space of the wellbore. When the first ram BOP 104 is in the closed position, the sealing members maintain the seal while allowing the tubular 200 to move up or down through the wellbore. During typical operations, the first ram BOP 104 is set to move to a specific and predetermined location within the wellbore so that the fluid-tight seal can be formed. This specific and predetermined location is based upon the outer diameter of the tubular 200 that is moving through the apparatus 100. The specific and predetermined location that defines the closed position of the first ram BOP 104 is not determined based upon the dimensions of any larger OD section 202 that is part of the tubing string 201 and that will pass through the apparatus 100 and the wellhead 102.

The annular BOP 110 also provides a fluid-tight seal about the tubular 200. The annular BOP 110 is positioned above the first ram BOP 104 and the second ram BOP 106. The annular BOP 110 includes a torus-shaped sealing member, which is also referred to as a sealing element 113. The sealing element 113 has a central aperture that is co-axial with the wellbore for receiving the tubular 200 as it passes therethrough. The sealing element 113 can be actuated to a closed position to form a fluid-tight seal between an inner surface of the central aperture and the outer surface of the tubular 200. When the sealing element 113 is so actuated, the tubular 200 can still pass through the central aperture while the fluid-tight seal is maintained. The sealing element 113 can also be actuated to an open position where there is no fluid-tight seal formed with the outer surface of the tubular 200. In some embodiments of the present disclosure the sealing element 113 can be hydraulically actuated, pneumatically actuated, mechanically actuated, electronically actuated or actuated by combinations thereof.

In some embodiments of the present disclosure, the sealing element 113 is hydraulically actuated by an inlet hydraulic line 115, which is also referred to as a close side, so that when hydraulic fluid flows through the inlet hydraulic line 115 the sealing element 113 actuates to the closed position. The sealing element 113 also has an outlet hydraulic line 117, which is also referred to as the open side, so that when hydraulic fluid flows through the outlet hydraulic line 117 the sealing element 113 is actuated to the open position. The sealing element 113 may also include an annular sensor 111 that is configured to detect when there is a change of pressure in the hydraulic fluid within the sealing element 113 that is not caused by a change of flow through the inlet hydraulic line 115 or the outlet hydraulic line 117. For example, when the sealing element 113 is actuated to the closed position, if a larger OD section 202 passes through the central aperture of the sealing element 113, there will be a change of pressure in either or both of the inlet hydraulic line 115 and the outlet hydraulic line 117 that will be detected by the annular sensor 111. In some embodiments of the present disclosure, the annular sensor 111 is configured to detect a change of pressure in the hydraulic fluid within the inlet hydraulic line 115, the outlet hydraulic line 117 or both.

The anti-collision apparatus 100 also comprises a first sensor 112 and optionally a second sensor 114. The first sensor 112 can be positioned between the wellhead 102 and the first ram BOP 104. In some embodiments of the present disclosure the second sensor 114 is positioned between the first ram BOP 104 and the second ram BOP 106. The first and second sensor 112, 114 are each configured to detect the presence of a magnetic body and measure the OD thereof as the magnetic body approaches, passes through and/or moves away from each of the sensors 112, 114. Examples of a magnetic body can be the tubular 200 and the larger OD section 202 that are moving through the apparatus 100.

Figure 3:
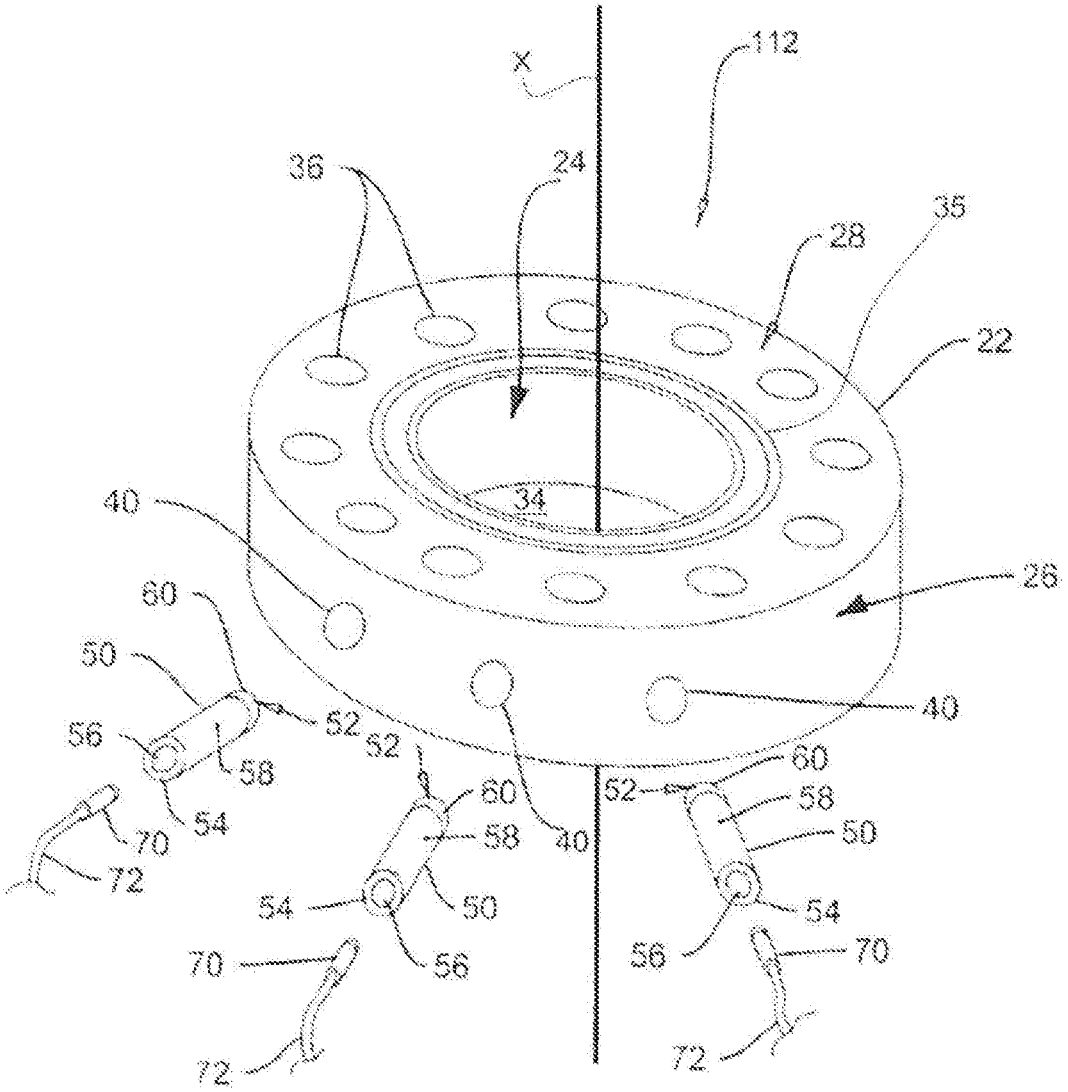
FIG. 3 is an isometric, exploded view of a sensor for use with the wellhead anti-collision apparatus of FIG. 1 or FIG. 2.
Figure 4:
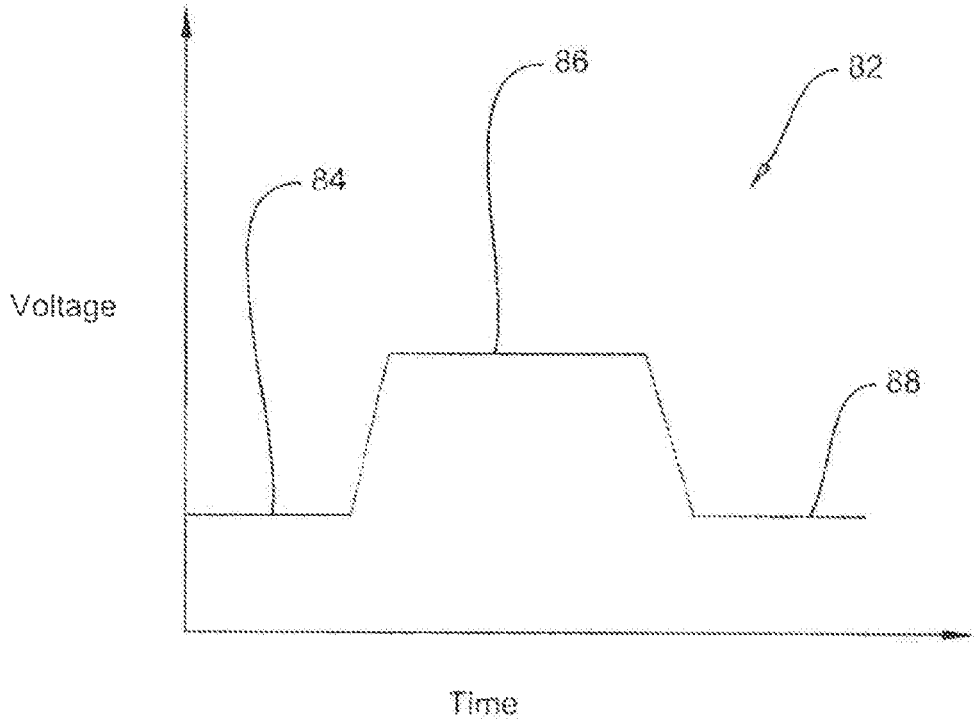
FIG. 4 is a diagram that represents an example output signal from the sensor of FIG. 3.

The sensors described in U.S. Pat. No. 9,097,813, the entire disclosure of which is incorporated herein by reference, are a non-limiting example of some embodiments that are suitable for use with the apparatus 100. For example, FIG. 3 shows one embodiment of the first sensor 112. The first sensor 112 and the second sensor 114 both perform the same function and can include the same components. Accordingly, the present disclosure will provide a description of the first sensor 112 and it is understood that unless otherwise stated, the same description applies to the second sensor 114.

With reference to FIG. 3, the first sensor 112 comprises a body 22 having a plurality of sensor bores 40 therein each adapted to receive a sleeve 58 and a sensor 70 therein. The body 22 is an annular or ring-shaped spool having inner surface 24 and an outer surface 26 that both extend between a top surface 28 and a bottom surface 30 of the body 22. The inner and outer surfaces 24, 26 are substantially cylindrical about a central axis, shown as line X in FIG. 3. When the first sensor 112 is integrated into the apparatus 100, the central axis X is co-axial with a central axis of the other components of the apparatus 100 and the wellhead 102. For clarity, the central axis X is co-axial with a central axis of at least the upper portion of the wellbore. The inner surface 24 defines a central passage 34 that extends therethrough and which may be sized and shaped to receive the tubulars 200 and the larger OD section 202, which can be of various dimensions and sizes. In some embodiments of the present disclosure, the top surface 28 and the bottom surface 30 may be substantially planar along a plane normal to the central axis X. Optionally either or both of the top surface 28 and the bottom surface 30 may include a seal groove 35 extending annularly therearound for receiving a seal as is known in the art.

In some embodiments of the present disclosure, the body 22 includes a plurality of bolt holes 36 that extend through the top surface 28 and the bottom surface 30 along an axis that may be substantially parallel to the central axis X. The bolt holes 36 are configured to receive fasteners 38, such as bolts, therethrough to secure the body 22 inline to the other components of the apparatus 100, according to methods known in the art.

The first sensor 112 also includes sensor bores 40 that extend from the outer surface 26 towards the inner surface 24. In some embodiments of the present disclosure, the sensor bores 40 are blind bores extending to a depth within the body 22 by a distance less than the distance from the outer surface 26 to the inner surface 24. In such a manner, the sensor bore 40 will maintain a barrier wall between the sensor bore 40 and the central passage 34 so as to maintain a fluid-tight seal. The barrier wall 42 may have a thickness selected to provide adequate burst strength of the first sensor 112. In other embodiments of the present disclosure, the sensor bore 40 extends completely through the body 22 to communicate between the inner surface 24 and the outer surface 26. The sensor bores 40 may be arranged about the central passage 34 along a common plane normal to the axis 32 of the central passage although it is appreciated by one skilled in the art that other orientations may be useful as well.

The body 22 may have any height between the top and bottom surfaces 28 and 30 as is necessary to accommodate the sensor bores 40. In some embodiments of the present disclosure the body 22 has a height between about 3.5 inches and about 24 inches (about 89 mm and about 610 mm). The body 22 may have an inner diameter (ID) of the inner surface 24 that allows the passage of the tubular 200 and the larger OD section 202 and an outer surface 26 OD that provides a sufficient depth for the sensor bores 40. In some embodiments of the present disclosure the body 22 has an OD of between about 4 and about 12 inches (about 102 mm and about 305 mm) larger than the ID. The body 22 may be formed of a non-magnetic material, such as, by way of non-limiting example a nickel-chromium alloy. One example of a non-magnetic material is INCONEL® (INCONEL is a registered trademark of Vale Canada Limited). It will also be appreciated by one skilled in the art that other materials may also be useful such as but not limited to duplex stainless steel, super duplex stainless steel provided these materials do not interfere with the sensor 70 operations as described below.

The sensor bores 40 are each configured to receive the sleeve 50. The sleeve 50 comprises a tubular member that extends between a first end 52 and a second end 54 and having an inner surface 56 and an outer surface 58. As illustrated in FIG. 3, the outer surface 58 of the sleeves 50 may be selected to correspond closely to the dimensions of the sensor bores 40 in the body 22. The sleeves 50 are formed of a substantially ferromagnetic material, such as steel so as to conduct magnetic flux as will be more fully described below. The sleeves 50 are selected to have a sufficient OD to be received within the sensor bores 40 and an inner surface diameter sufficient to accommodate a sensor 70 therein. In some embodiments of the present disclosure the sleeve 50 has an ID of between about 0.5 of an inch and about 1 inch (about 13 mm and about 25 mm). The sleeve 50 may also have a length that is sufficient to receive the sensor 70 therein, for example between about 0.5 of an inch and about 3 inches (about 13 mm and about 76 mm). The OD of the sleeve 50 may also optionally be selected to permit the sleeve 50 to be secured within one sensor bore 40 by an interference fit or with the use of adhesives, fasteners, plugs or the like.

The sleeves 50 may also include a magnet 60 that is positionable at the first end 52 thereof. The magnets 60 are selected to have strong magnetic fields. In particular, it has been found that rare earth magnets, such as but not limited to: neodymium, samarium-cobalt or electromagnets. The magnets 60 may be nickel plated, or not. The magnets 60 are located at the first ends 52 of the sleeves 50 and retained in place by the magnetic strength of the magnets. Optionally, the sleeve 50 may include an air gap (not shown) between the magnet 60 and the barrier wall 42 of up to about 0.5 of an inch (about 13 mm) although other distances may be useful as well.

A sensor 70 is insertable into the open second end 54 of each sleeve 50 and is retained within the sleeves 50 by any suitable means, such as but not limited to: adhesives, threading, fasteners or the like. The sensors 70 are selected to provide an output signal in response to the magnetic field in their proximity. For example, the sensors 70 may comprise magnetic sensors, such as a Hall Effect sensor although it will be appreciated that other sensor types may be utilized as well. In some embodiments of the present disclosure a Hall Effect sensor, such as a model SS496A1 sensor manufactured by Honeywell is useful although it will be appreciated that other sensors will also be suitable. The sensor 70 may be located substantially at a midpoint within each sleeve 50 although it will be appreciated that other locations within the sleeve 50 may be useful as well.

The sensor 70 is configured to provide an output signal 310 to a controller 300. The sensor 70 may be wired via wire 62 or the sensor 70 may be wirelessly or otherwise connected to the controller 300. The sensor 70 is configured so that the output signal 310 represents the OD of a magnetic object, such as the tubular 200 or the larger OD section 202, that is located within the central passage 34.

The controller 300 may be any of the commonly available personal computers or workstations having a processor, volatile and non-volatile memory, and an interface circuit for interconnection to one or more peripheral devices for data input and output. Processor-executable instructions, in the form of application software, may be loaded into the memory of the controller 300 that allows the controller 300 to adapt its processor to receive, store and query various input signals. In some embodiments of the present disclosure, the controller 300 can also send one or more instructions or commands to other components of the apparatus 100. For example, the controller 300 can send a display signal 302 to a display 304 that visually displays the signal output 310 by the one or more sensors 70 over time (see FIG. 4). During a first time period, the voltage signal is at a first level 84, which may occur when a main portion of a tubular 200 is moving through the central passage 34. As the tubular 200 moves through the spool 22, the voltage output of the sensors 70 may increase to a second level 86, which may occur due to the larger OD section 202 that is approaching, moving within and moving away from the central passage 34. After the larger OD section passes through the central passage 34, the voltage will return to a third level 88, which may be the same as the first level 84 or not.

Figure 5:
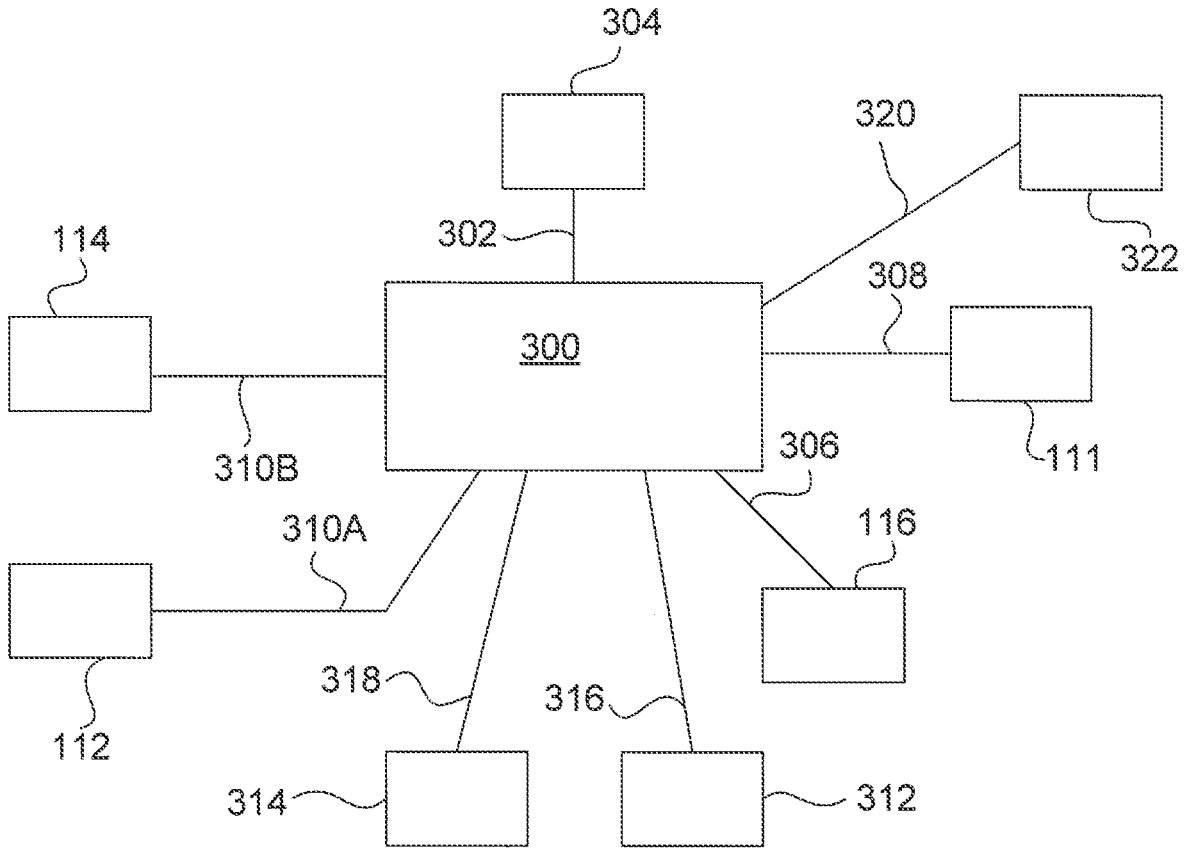
FIG. 5 is a schematic of a system with a controller and various inputs and outputs thereof for use with the wellhead anti-collision apparatus of FIG. 1 or FIG. 2.

Some embodiments of the present disclosure relate to use of various further sensors throughout the anti-collision apparatus 100 (see FIG. 5). The various sensors can provide timed updates of information to the controller 300 and/or the controller can query one or all sensors for an information update. The sensor information can be stored on the memory of the controller 300 for checking by the controller 300 at a later time. For example, the first sensor 112 provides a first sensor output 310A and the second sensor provides a second sensor output 310B, both to the controller 300. The hydraulic jack plate 108 may include a distance sensor 116 that measures the distance of the jack plate 108 relative to another non-moving component of the apparatus 100. The distance sensor 116 provides a direction output signal 306 to the controller 300. In some embodiments of the present disclosure, the distance sensor 116 may be a temposonic distance-sensor or a laser distance-sensor. The direction output signal 306 indicates the direction that the jackplate 108 is moving a tubular 200 through the upper portion of the wellbore and the wellhead 102. For example, if the distance sensor 116 detects a decrease in distance then the direction output signal 306 can inform the controller 300 that the jackplate 108 is moving a tubular 200 towards the wellhead 102. Conversely, if the jackplate 108 is moving a tubular away from the wellhead 102 then the direction output signal 306 can inform the controller 300 that the jackplate 108 is moving in that direction. In some embodiments of the present disclosure, the direction that the jackplate 108 is moving a tubular 200 determines a mode of the apparatus 100. For example, the apparatus 100 can be in a "run-in" mode that corresponds with when the jackplate 108 is inserting a tubular 200 into the wellhead 102. Alternatively, the apparatus 100 can be in a "run-out" mode that corresponds with when the jackplate 108 is pulling a tubular 200 out of the wellhead 102.

Some embodiments of the present disclosure may include one or more slip position sensors (not shown) that provide a slip position output signal to the controller 300. The slip position output signal indicates whether the slips are open or closed. When the slips are open, the jackplate 108 can move without moving the tubular 200. When the slips are closed the jack plate 108 will move and move the tubular 200 with it.

Run-In Mode

Some embodiments of the present disclosure relate to the annular sensor 111 that provides an annular BOP output signal 308 to the controller 300. The annular sensor 111 detects when a larger OD section 202 passes through the sealing element, which causes a change in the pressure within the sealing element 113. For example, the sealing element 113 may be a hydraulically actuatable body that receives and expels hydraulic fluid by the inlet hydraulic line 115 and the outlet hydraulic line 117, respectively. The annular sensor 111 may be configured to detect changes in hydraulic pressure within the inlet hydraulic line 115 so that when the larger OD section 202 passes through the annular BOP 110 the sealing element 113 will deform to accommodate the larger OD section 202. This deforming of the sealing element 113 results in a change of hydraulic pressure that is detectable by the annular sensor 111. In some embodiments of the present disclosure, when the controller 300 receives the annular BOP output signal 308, the controller 300 can compare with the latest direction output signal 306 received to confirm that the apparatus 100 is working in the run-in mode.

Some embodiments of the present disclosure relate to ram BOP position sensors that provide positional information to the controller 300 regarding whether the ram BOPs are open or closed. For example, the first ram BOP 104 includes a first ram position sensor 312 that detects whether the rams of the first ram BOP 104 are in the open position, the closed position or an intermediary position. The first ram position sensor 312 provides a first ram position output signal 316 to the controller 300 that indicates the position of the first ram BOP 104. The second ram BOP 106 includes a second ram position sensor 314 that provides a second ram position output signal 318 to the controller 300 that indicates the position of the second ram BOP 106. One example of suitable ram BOP position sensors is a linear variable differential transformer, however, the person skilled in the art will appreciate that other positional sensors are also suitable.

The controller 300 may receive updated direction output signals 306 that correspond with a predetermined distance that the tubular 200 has moved through the apparatus 100.

When the slip position output signal indicates that the slips are open, then the controller 300 will engage a passive mode whereby the updated direction output signals 306 will not cause a change of some aspect or functionality of the apparatus 100. However, when the slip position output signal indicates that the slips are closed, then the controller 300 will change to an active mode and the updated direction output signals 306 will cause the controller 300 to change some aspect or functionality of the apparatus 100. In some embodiments of the present disclosure, the predetermined distance is the distance between the first sensor 112 and the second ram BOP 106 or the distance between the second sensor 114 and the first ram BOP 104. When the tubular 200 has moved the predetermined distance, the controller 300 will check the latest second ram position output signal 318 to determine if the second ram BOP 106 is open or closed. If the second ram position output signal 318 indicates that the second ram BOP 106 is closed, then the controller 300 will send a dump command 320 to an electric pilot pressure control valve 322 that controls the flow of hydraulic fluid to the jackplate 108 or a jackplate actuator 108A. In some embodiments, there may be an electric pilot pressure control valve 322 for each direction that the jackplate 108 moves, for example one valve for run-in and one valve for run-out. For the purposes of the present disclosure, it is understood that the controller 300 will send the dump command 320 to which ever valve is required to prevent further movement of the larger OD section 202 towards a closed ram BOP. For example, the dump command 320 causes the electric pilot pressure control valve 322 to dump hydraulic fluid into one or more secondary circuits so that the jackplate 108 or the jackplate actuator 108A cannot move the tubular 200 and the larger OD section 202 any further. The one or more secondary circuits may include a braking circuit to assist with stopping movement of the tubular 200 and the larger OD section 202. The controller 300 will maintain this status until such time that a new second ram position output signal 318 is received that indicates that the second ram BOP 106 is no longer in the closed position. Then the controller 300 will stop sending the dump command 320 and the electric pilot pressure control valve 322 may re-direct the flow of hydraulic fluid to the jackplate 108 or the jackplate actuator 108A. At this point, the jackplate 108 can resume running the tubular 200 into the well below.

Figure 1C:
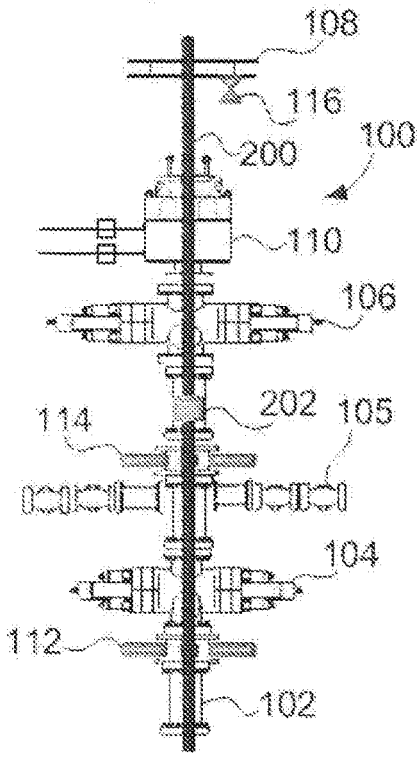
FIG. 1C shows the tubular at a third, lower position.
Figure 1D:
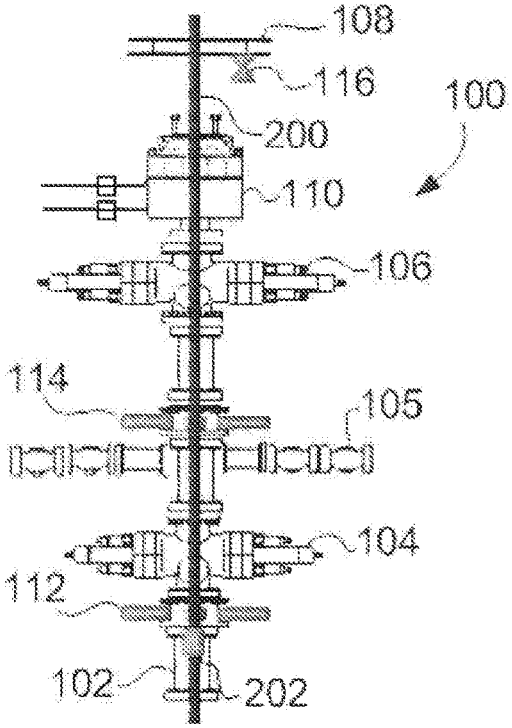
FIG. 1D shows the tubular at a fourth, lower position.
Figure 2A:
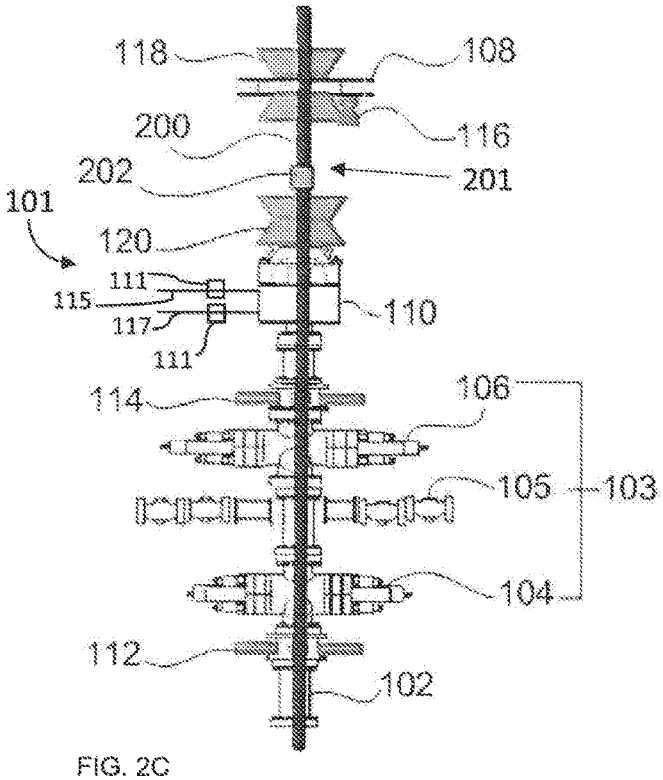
FIG. 2A shows a tubular being run into a well through the anti-ram collision apparatus, the tubular is at a first position.
Figure 2B:
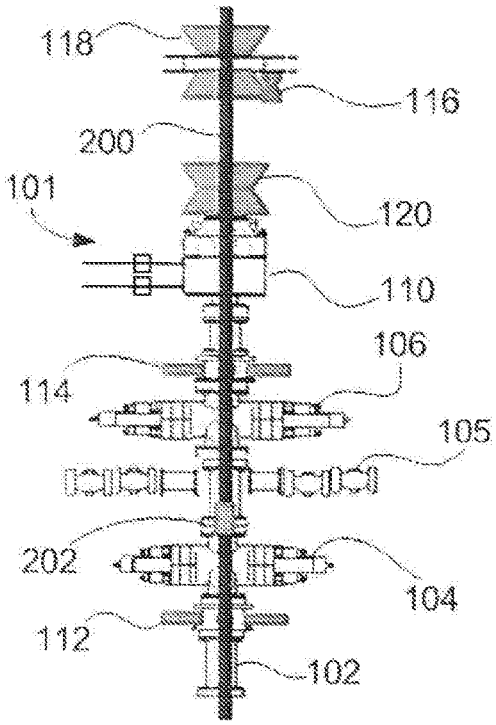
FIG. 2B shows the tubular at a second, lower position.
Figure 2C:
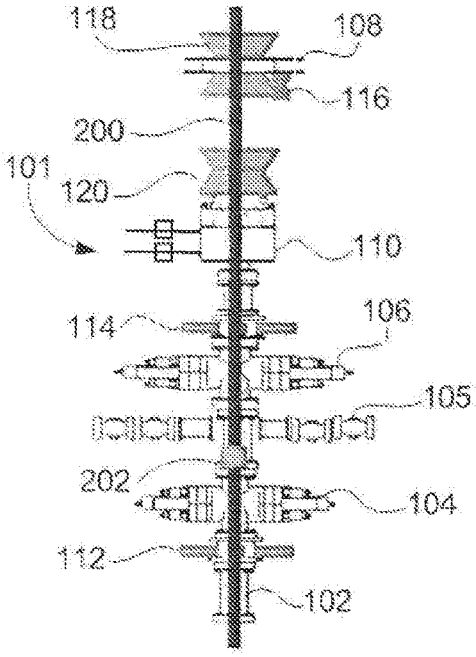
FIG. 2C shows the tubular at a third, lower position.
Figure 2D:
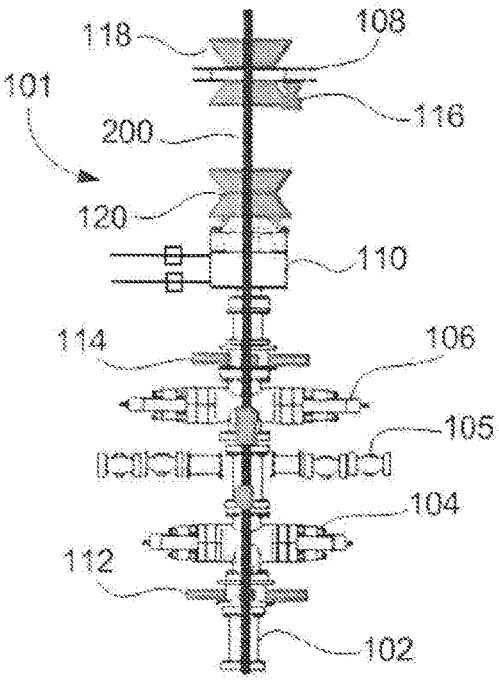
FIG. 2D shows a shorter tubular at a position within the wellhead anti-collision apparatus.

As the tubular 200 passes through the apparatus 100, the larger OD section 202 will approach and enter the second sensor 114 (see FIG. 1C). The second sensor 114 will send an updated second sensor output 310B to the controller 300. The controller 300 will check the latest first ram position output signal 316 received to determine if the first ram BOP 104 is open or closed. If the first ram BOP 104 is closed, then the controller 300 will send another dump command 320 to the electric pilot pressure control valve 322 so that the tubular 200 cannot be run-in any further towards the closed first ram BOP 104. If the latest first ram position output signal 316 received by the controller 300 indicates that the first ram BOP 104 is open, then no dump command 320 is sent to the controller 300. If the first ram BOP 104 actuates from a closed position to an open position, or vice versa, the second sensor output 310B can update the information sent to the controller 300 accordingly.

When the larger OD section 202 approaches and enters the first sensor 112 (see FIG. 1D) the first sensor 112 will send an updated first sensor output 310A to the controller 300. At this point, while in the run-in mode, the controller 300 will not interfere with the flow of hydraulic fluid to the jackplate 108 or the jackplate actuator 108A until another larger OD section 202 is detected by the annular sensor 111.

Run-Out Mode

In the run-out mode, the larger OD section 202 will first be detected by the first sensor 112, which will send an updated first sensor output 310A to the controller 300. The controller 300 will review the latest first ram position output signal 316. If the first ram BOP 104 is open then the controller 300 will not take any action. If the first ram BOP 104 is closed then the controller 300 will send a dump command 320 to the jackplate 108 or the jackplate actuator 108A to dump hydraulic fluid into a secondary circuit so that the jackplate 108 or the jackplate actuator 108A cannot move the tubular 200 any further out of the well below. If the first ram position output signal 316 indicates to the controller 300 that the first ram BOP 104 has opened, then the controller 300 will stop sending the dump command 320 and the pilot pressure control valve 322 may re-direct the flow of hydraulic fluid to the jackplate 108 or the jackplate actuator 108A.

As the tubular ascends through the apparatus 100, the larger OD section 202 will pass through the first ram BOP 104 and then approach and enter the second sensor 114. When the controller 300 receives the second sensor output 310B the controller 300 will review the position of the second ram BOP 106 by checking the latest second ram position output signal 318. If the second ram BOP 106 is closed then the controller 300 will send a dump command 320 to the electrical pilot pressure control valve 322. Alternatively, if the second ram BOP is open then the controller 300 will not take any action to interfere with the movement of the tubular 200 through the apparatus 200.

When the annular sensor 111 detects the presence of the larger OD section 202 within the annular BOP 110, the controller 300 will not take any further steps to interfere with the movement of the tubular 200 through the apparatus 100.

In both the run-in mode and the run-out mode, the apparatus 100 ensures that there is no movement of the larger OD section 202, towards a closed ram BOP. The movement of a larger OD section 202 of the tubing string 201 towards a closed ram BOP may be referred to herein as an imminent collision state. When the controller 300 identifies an imminent collision state, the controller 300 will send one or more commands, such as the dump command 320 or others, to prevent further movement of the tubing string 201. Preventing further movement of the tubing string 201 will avoid the collision. This allows the operator to ensure that at least one of the first ram BOP 104 or the second ram BOP 106 are in the closed position while the tubular 200 is moving through the apparatus 100 and while avoiding an imminent collision state.

In other embodiments of the present disclosure the second sensor 114 is not positioned between the two ram BOPs 104, 106, rather the second sensor 114 is positioned between the second ram BOP 106 and the annular BOP 110.

FIG. 2 shows another embodiment of the present disclosure that relates to an anti-collision apparatus 101. Similar to the apparatus 100, the apparatus 101 can operate in a run-in mode and a run-out mode. Unless otherwise indicated herein, it is understood that the anti-collision apparatus 101 has the same components that perform the same functions as described above for apparatus 100. FIG. 2A through FIG. 2C show the movement of the tubular 200 and the larger OD section 202 through the apparatus 101.

At least one difference between the apparatus 100 and the apparatus 101 is the position of the second sensor 114 on the apparatus 101. As shown in FIG. 2, the second sensor 114 is positioned above the second ram BOP 106, rather than between the two ram BOPs 104, 106 as in the apparatus 100. Accordingly, the apparatus 101 may not require the annular sensor 111.

The apparatus 100, 101 may have one or more travelling slips 118 that are positioned at or near the jackplate 108. The travelling slips 118 have a load sensor 324 and a position sensor 326. The load sensor 324 sends a load sensor output 328 to the controller 300 to indicate whether or not the travelling slip 118 is loaded with the tubular 200. If the load sensor output 328 indicates that the travelling slip 118 is not loaded with the tubular 200, then the controller 300 will remain passive until the load sensor output 328 is updated to indicate that the travelling slip 118 is loaded. The position sensor 326 can send a position sensor output 330 to the controller 300 to indicate the position of the travelling slips 118. In some embodiments of the present disclosure, the position sensor 326 can be a temposonic sensor, however, the skilled person will appreciate that other types of sensors are also useful. If the load sensor output 328 indicates that there is no tubular 200 loaded within the travelling slips 118, then the controller 300 will not take any action to interfere with movement of the jackplate 108 or the jackplate actuator 108A.

The apparatus 100, 101 may also have one or more stationary slips 120 that are positioned proximal the annular BOP 110. The stationary slips 120 also include a stationary slip load sensor 332 that sends a stationary slip load sensor output 336 to the controller 300 to indicate whether or not the stationary slips 120 are loaded with a tubular 200.

With the additional sensory information from the travelling slip 108 and the stationary slip 120, the controller 300 can now measure and track bottom hole assemblies, collars and downhole tools as they pass through the apparatus 100, 101. The controller 300 can also additively construct a virtual copy of the entire tubing string 201 as it is built at the surface and track the movement of the tubing string 201 components downhole by storing the information regarding the dimensions and spacing of the various larger OD sections 202 within the tubing string 201. Optionally, the controller 300 constructed virtual copy of the tubing string 201 is displayed on the display 304 and it allows the operator to watch a larger OD section 202 move through the apparatus 100, 101. Additionally, the controller 300 may tally the number of tubulars 200 run-in or run-out of the well to ensure that the tubing string 201 and any downhole tools thereon are properly positioned within the lower portion of the wellbore.

When operating in the run-in mode, if the second sensor 114 detects the larger OD section 202 the controller 300 will identify an imminent collision state unless the second ram BOP output signal 318 indicates that the second ram BOP 106 is open. If the second ram BOP 106 is open, then the controller 300 will not issue the dump command 320. This will allow the jackplate 108 or the jackplate actuator 108A to continue running the tubular 200 into the well. For as long as the second sensor output 310B indicates that the larger OD section 20 is passing through the second sensor 114, the controller 300 will measure how far the travelling slips 118 move by repeatedly checking the position sensor output 330. This measurement will allow the controller 300 to measure the length of the larger OD section 202, which will be stored on the controller's 300 memory. The controller 300 will also compare the length of the larger OD section 202 against a predetermined distance that is also stored on the controller's 300 memory. The predetermined distance for when the apparatus 100, 101 is operating in the run-in mode is the distance between the second sensor 114 and the first ram BOP 104. The predetermined distance for when the apparatus 100, 101 is operating in the run-out mode is the distance between the first sensor 114 and the second ram BOP 106. In some embodiments of the present disclosure, the predetermined distance is about the same regardless of what mode the apparatus 100, 101 is operating in. For example, the predetermined distance may be between about 1.5 meters and 2.5 meters.

The controller 300 will identify an imminent collision state if the larger OD section 202 has passed through the second ram BOP 106 and is therefore approaching the first ram BOP 104 and the first ram output signal 316 indicates that the first ram BOP 104 is closed. However, if the first ram output signal 316 indicates that the first ram BOP 104 is open, then the controller 300 will not send the dump command 320 until the tubular 200 has travelled a sufficient distance to ensure that the length of the larger OD section 202 has entirely passed through the first ram BOP 104.

In some scenarios, the apparatus 100, 101 may be working in either the run-in mode or the run-out mode but the direction that the tubular 200 is travelling may reverse. If the position sensor output 330 indicates that the travelling slips 118 have moved to a position that is opposite to the mode the apparatus 101 is in (i.e. if the travelling slips 118 have moved further from the wellhead 102 when in the run-in mode or if the travelling slips 118 have moved closer to the wellhead 102 when in the run-out mode) then the controller 300 will perform a calculation to determine the allowable distance that the tubular 200 can travel in the new direction. The calculation is based upon the last known position the larger OD section 202 relative to the two ram BOPs 104, 106. The controller 300 may also query the state of the ram BOP that is next in the tubular's 200 new direction of travel and if it is closed, the controller 300 will identify an imminent collision state once the tubular 200 has travelled the allowable distance. The controller 300 will then send the dump command 320 to prevent further movement of the tubular 200.

In some instances, shorter tubulars, such as pup joints, can be used in a tubing string 201. The length of the pup joint can sometimes be smaller than a staging chamber that is defined between the two ram BOPs 104, 106. As the pup joint, which is bookended by two larger OD couplers, moves through the second sensor 114, the controller 300 will calculate the entire length between the two opposite ends of the couplers (see FIG. 2D). The controller 300 will compare this calculated length with the known length of the staging chamber and the controller 300 will send an output message 302 to the display to advise the user if the calculated length is larger than the staging chamber so that the user can adjust operations accordingly.

In some instances, the tubular 200 can slip or slide while loaded in the jackplate 108. This slippage can be detected by either or both of the load sensors 324, 332 which are then sent as a slip output signal to the controller 300. If the controller 300 receives a slip output signal then the controller 300 will send the dump command 320 and prevent any further movement of the tubular 200 in the same direction. The controller 300 will also send a slip notice to the display 304 so that the operator can reverse the direction of jack plate 108 movement if required. The controller 300 will not lift the dump command 320 to allow further tubular 200 travel in the direction of travel prior to receiving the slip output signal until such time that either or both of the sensors 112, 114 detect the closest larger OD section 202.

Some embodiments of the present disclosure relate to an operator override function whereby the operator can shut down the apparatus 100 by overriding the controller 300 to cause all movement of the apparatus 100 to stop.

We claim:

1. An apparatus for avoiding collisions while moving a section of a tubing string through a wellhead, the apparatus comprising:

a. a blowout preventer (BOP) system that is co-axially connectible with the wellhead, the BOP system is configured to receive the tubing string therethrough and to move between an open position and a closed position, when in the closed position the BOP system forms at least one fluid tight seal against an outer surface of the tubing string, wherein the BOP system generates a BOP output signal that indicates when the BOP system is in the closed position;

b. a body with a central bore, the body is co-axially connectible with the wellhead;

c. a sensor for measuring an outer diameter (OD) of the tubing string as it passes through the central bore, the sensor is configured to generate a sensor output signal that indicates the OD of the tubing string;

d. a jack plate for moving the tubing string through the apparatus;

e. a distance sensor for generating a direction output signal that indicates a direction that the jack plate is moving; and f. a controller that is configured to receive the sensor output signal, the direction output signal and the BOP output signal to determine if an imminent collision state exists, wherein the imminent collision state exists if a larger OD section of the tubing string is approaching the BOP system while in the closed position.

2. The apparatus of claim 1, wherein if the imminent collision state exists the controller will send one or more commands to avoid a collision.

3. The apparatus of claim 2, wherein the one or more commands to avoid the collision comprise one or more of a command to move the BOP system to the open position and a command to stop movement of the tubing string.

4. The apparatus of claim 2, wherein the one or more commands comprise a stop command to stop movement of the tubing string.

5. The apparatus of claim 4, wherein the jack plate is hydraulically actuated and the stop command comprises a dump command to redirect hydraulic fluid to one or more secondary circuits.

6. The apparatus of claim 5, wherein the one or more secondary circuits comprise a braking circuit.

7. The apparatus of claim 1, wherein the BOP system comprises:

a. a first ram BOP that is connectible to the wellhead proximal the sensor, the first ram BOP is configured to generate a first ram BOP output signal that indicates whether the first ram BOP is in an open position or a closed position; and b. a second ram BOP that is connectible proximal the first ram BOP, the second ram BOP is configured to generate a second ram BOP output signal that indicates whether the second ram BOP is in an open position or a closed position, wherein the BOP output signal comprises the first ram BOP output signal and the second ram BOP output signal.

8. The apparatus of claim 7 further comprising a second sensor for detecting the OD of the tubing string as it passes through a central bore of the second sensor, the second sensor is configured to generate a second sensor output that indicates the OD of the tubing string, wherein the second sensor output is receivable by the controller.

9. The apparatus of claim 8, wherein the sensor is positionable below the first ram BOP.

10. The apparatus of claim 9, wherein the second sensor is positionable between the first ram BOP and the second ram BOP.

11. The apparatus of claim 9, wherein the second sensor is positionable above the second ram BOP.

12. The apparatus of claim 1, further comprising a second sensor for detecting the OD of the tubing string as it passes through the central bore, the second sensor is configured to generate a second sensor output that indicates the OD of the tubing string, wherein the second sensor output is receivable by the controller.

13. The apparatus of claim 1, wherein the BOP system further comprises an annular BOP that is configured to receive the tubing string therethrough and to move between an open position and a closed position, when in the closed position the annular BOP forms at least one fluid tight seal against an outer surface of the tubing string, wherein the annular BOP system generates an annular BOP output signal that indicates when the annular BOP system is in the closed position, and wherein the annular BOP output signal is receivable by the controller.

14. The apparatus of claim 1, wherein the jack plate comprises one or more travelling slips for engaging the tubular while moving the tubing string through the apparatus, wherein the one or more travelling slips comprise a load sensor for generating a load sensor output that indicates if the travelling slip is loaded with a section of the tubing string, and wherein the load sensor output is receivable by the controller.

15. The apparatus of claim 14, wherein the one or more travelling slips comprise a position sensor that indicates the position of the one or more travelling slips, and wherein the position sensor output is receivable by the controller.

16. The apparatus of claim 15, further comprising a stationary slip that is positionable proximal an upper section of the apparatus, opposite to the wellhead, the stationary slip comprises a stationary slip load sensor that is configured to generate a stationary slip load sensor output signal that indicates whether the stationary slip is loaded with a section of the tubing string, wherein the stationary slip load sensor output is receivable by the controller.

17. The apparatus of claim 16, wherein the controller additively constructs a virtual copy of the tubing string based upon receiving the sensor output signal, the load sensor output, the position sensor output and the stationary slip load sensor output.

18. The apparatus of claim 1, wherein the jack plate comprises one or more travelling slips for engaging the tubular while moving the tubing string through the apparatus, wherein the one or more travelling slips comprise a position sensor that indicates the position of the one or more travelling slips, and wherein the position sensor output is receivable by the controller.

19. The apparatus of claim 1, further comprising a stationary slip that is positionable proximal an upper section of the apparatus, opposite to the wellhead, wherein the stationary slip comprises a stationary slip load sensor that is configured to generate a stationary slip load sensor output signal that indicates if the stationary slip is loaded with a section of the tubing string, and wherein the stationary slip load sensor output is receivable by the controller.

20. The apparatus of claim 1, wherein the distance sensor comprises a temposonic distance-sensor or a laser distance-sensor.

* * * * *